US006313725B1

(12) United States Patent
Nagashima et al.

(10) Patent No.: US 6,313,725 B1
(45) Date of Patent: Nov. 6, 2001

(54) MAGNETIZING METHOD FOR PRODUCING COUPLED BODY COMPRISED OF MULTI-POLE BULK SUPERCONDUCTING MAGNETS WITH RESPECTIVE POLARITIES VARYING

(75) Inventors: Ken Nagashima; Masato Murakami; Takeshi Miyamoto, all of Tokyo; Atsuyuki Kobayashi, Saitama-ken; Osami Tsukamoto, Tokyo, all of (JP)

(73) Assignees: Railway Technical Research Institute; International Superconductivity Technology Center, both of Tokyo (JP)

( * ) Notice: Subject to any disclaimer, the term of this patent is extended or adjusted under 35 U.S.C. 154(b) by 0 days.

(21) Appl. No.: 09/668,617

(22) Filed: Sep. 22, 2000

(30) Foreign Application Priority Data

Sep. 24, 1999 (JP) ..... 11-271195

(51) Int. Cl.[7] ..... H01F 7/00
(52) U.S. Cl. ..... 335/216; 335/296
(58) Field of Search ..... 335/216, 296–299, 335/302–306, 284, 285, 286, 287; 505/705, 725, 739, 740, 741

(56) References Cited

U.S. PATENT DOCUMENTS 5,208,571 * 5/1993 Muller ..... 35/299

FOREIGN PATENT DOCUMENTS 7-111213 4/1995 (JP) .
2001-44032 * 2/2001 (JP) .

* cited by examiner

*Primary Examiner*—Lincoln Donovan
*Assistant Examiner*—Tuyen T. Nguyen
(74) *Attorney, Agent, or Firm*—Flynn, Thiel, Boutell & Tanis, P.C.

(57) ABSTRACT

The invention is to establish means of producing easily and at low cost "a coupled body of superconducting magnets", comprised of multi-pole bulk superconducting magnets lined up such that the polarities thereof alternately vary so as to cause a magnetic field gradient to occur. The magnetizing method for producing a coupled body comprised of multi-pole bulk superconducting magnets with respective polarities varying comprises the steps of coupling adjacent members for bulk superconducting magnets of a plurality of members for bulk superconducting magnets with each other in such a way as to be freely superposable, foldable, and unfoldable, superposing all the members for the bulk superconducting magnets on top of one after another, and applying a magnetizing process thereto in as superposed state, and unfolding alternately and juxtaposing the respective bulk superconducting magnets as superposed after the magnetizing process as shown in FIG. 1(A) to FIG. 1(D).

2 Claims, 2 Drawing Sheets

MAGNETIZING METHOD FOR PRODUCING COUPLED BODY COMPRISED OF MULTI-POLE BULK SUPERCONDUCTING MAGNETS WITH RESPECTIVE POLARITIES VARYING

FIELD OF THE INVENTION

The invention relates to a magnetizing method for producing "a coupled body of superconducting magnets", comprised of multi-pole bulk superconducting magnets, as magnetized and lined up such that respective polarities alternately vary, and is intended to provide members for producing a magnetic field suitable to, for example, a linear motor, a rotating motor, an actuator, a magnetic separation system, and so forth.

RELATED ART

Upon discovery of oxide superconductors having the critical temperature exceeding liquid nitrogen temperatures, there have since been made available various high-temperature superconducting materials, and application techniques for high-temperature superconducting coils and bulk superconductors, using such materials, have been under intense study lately.

Now, as described in, for example, Japanese Patent Laid-open No. H 7-111213, it has been known that a strong magnetic field can be arrested by bulk superconductors such as a high-temperature RE—Ba—Cu—O based oxide superconducting bulk body (Re refers to rare earth elements such as Y, La, Nd, Sm, Eu, Gd, Dy, Ho, Er, Tm, Yb, and so forth), and so forth by taking advantage of a large pinning effect of the pinning center formed therein, and the bulk superconductors can therefore be utilized as pesudo-permanent magnets, and there has already been obtained material capable of arresting a magnetic field having a strength in excess of 10 T.

Also, it is under study to apply such bulk superconductors to prime movers such as a rotating motor, a linear motor, an actuator, and so forth, a magnetic separation system for separating magnetic substances from a mixture (used in, for example, sorting of ores, processing of effluent from factories, recycling process of paper, and the like), and so forth by utilizing a strong magnetic field arrested by the bulk superconductors.

It is to be pointed out, however, that a driving force caused by a magnetic field is largely dependent on not only the strength of the magnetic field but also a magnetic field gradient. It follows that if the magnetic field gradient is zero, the driving force will not act on a magnetic body however strong the magnetic field may be.

Accordingly, for obtaining a magnetic driving force by the agency of a permanent magnet, and the like, it is necessary to line up a plurality of magnets such that the polarities of the respective magnets vary one after another, thereby causing a magnetic field gradient to occur.

For this reason, in the case of, for example, the rotating motor, linear motor, actuator, magnetic separation system, and so forth as described above, magnets are lined up such that the polarities of adjacent magnets alternately vary with the aim of causing a magnetic field gradient to occur.

In order to implement such lineup of magnets, it has been necessary to magnetize a plurality of members for magnetization, respectively, by applying a magnetizing process thereto before lining up magnetized members such that the polarities thereof alternately vary, or to provide each of a plurality of members for magnetization, already lined up in a predetermined arrangement, with a coil for use in a magnetizing process, and subsequently to magnetize each of the members for magnetization such that the polarities of the adjacent members as magnetized alternately vary.

However, with "a method of magnetizing members for magnetization by providing each of the members for magnetization with a coil for use in a magnetizing process", a magnetizing system becomes complex and redundant. Accordingly, the method may be permissible for mere research purposes, but it has posed a major problem with its use as industrial means in respect of cost and work efficiency.

Meanwhile, with "a method of magnetizing members for magnetization, respectively, before lining up the members as magnetized such that the polarities thereof alternately vary", the following problem has been encountered in the case of the members for magnetization being bulk superconductors, and accordingly, this method has not been regarded as practical means either.

More specifically, as a magnetizing method for bulk superconducting magnets, a method (method of cooling in a magnetic field) is normally adopted, whereby bulk superconductors are disposed in a space of a magnetic field produced by a superconducting coil magnet, the bulk superconductors in this state are cooled to the critical temperature thereof or lower in the magnetic field, and subsequently, the magnetic field is removed.

However, it has been inevitable to determine that "the method of magnetizing members for magnetization, respectively, before lining up the members as magnetized such that the polarities thereof alternately vary" is unsuitable for industrial means in the case of producing bulk superconducting magnets because the bulk superconducting magnets after magnetization have already been cooled to an extremely low temperature, and in addition, have a very strong magnetic force, so that it is very difficult and risky to line up such bulk superconducting magnets such that the directions of magnetization (polarities) thereof vary individually, thereby causing a magnetic field gradient to occur.

This problem has turned out more serious with bulk superconducting magnets having potential for excellent performance, and capable of arresting a large magnetic field.

SUMMARY OF THE INVENTION

Under the circumstance, an object of the invention is to establish means of producing easily and at low cost "a coupled body of superconducting magnets", comprised of multi-pole bulk superconducting magnets lined up such that the polarities thereof alternately vary so as to cause a magnetic field gradient to occur.

The inventors have carried out intense studies to achieve the object described above, and as a result, have succeeded in obtaining novel and singular knowledge that a coupled body comprised of multi-pole bulk superconducting magnets, having an alternating magnetic field, and a large magnetic field gradient, can be obtained simply and easily by coupling a plurality of members for bulk superconducting magnets with each other in such a way as to be freely foldable, and unfoldable by use of a freely foldable coupling mechanism such as a hinge or the like when magnetizing the members for the bulk superconducting magnets, and applying a magnetizing process to the plurality of the members for the bulk superconducting magnets in as folded state before unfolding and releasing the same.

The invention has been developed on the basis of the knowledge described above, and it is an object of the invention to provide "a magnetizing method for producing a coupled body comprised of multi-pole bulk superconducting magnets with respective polarities varying" as described hereinafter:

(1) a magnetizing method for producing a coupled body comprised of multi-pole bulk superconducting magnets with respective polarities varying, comprising the steps of coupling adjacent members for bulk superconducting magnets of a plurality of members for bulk superconducting magnets with each other in such a way as to be freely superposable, foldable, and unfoldable, superposing all the members for the bulk superconducting magnets on top of one after another, and applying a magnetizing process thereto in as superposed state, and unfolding alternately and juxtaposing the respective bulk superconducting magnets as superposed after the magnetizing process; and (2) a magnetizing method for producing a coupled body comprised of multi-pole bulk superconducting magnets with respective polarities varying, wherein the magnetizing process is applied to a superposed body of the members for the bulk superconducting magnets by keeping superposing faces of the respective members for the bulk superconducting magnets in an half-open state so as to have an angle formed between the superposing faces of the adjacent members for the bulk superconducting magnets without the superposing faces coming into close contact with each other.

DETAILED DESCRIPTION OF THE INVENTION

A magnetizing method for producing a coupled body comprised of multi-pole bulk superconducting magnets with respective polarities varying according to a preferred embodiment of the invention is described with reference to FIGS. 1(A) to 1(D) and 2.

FIGS. 1(A) to 1(D) are views showing an example of a process for carrying out "a magnetizing method for producing a coupled body comprised of multi-pole bulk superconducting magnets with respective polarities varying" according to the invention.

Figure 1A:
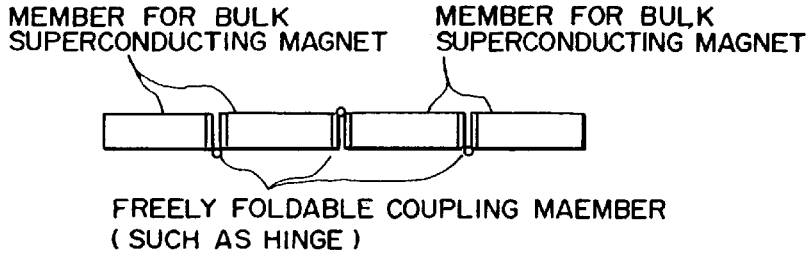
FIGS. 1(A) to 1(D) are views showing an example of a process for carrying out "a magnetizing method for producing a coupled body comprised of multi-pole bulk superconducting magnets with respective polarities varying" according to the invention.

According to the method of the invention, first of all, members for multi-pole bulk superconducting magnets, e.g., a high-temperature RE—Ba—Cu—O based oxide superconducting bulk body (RE refers to rare earth elements such as Y, La, Nd, Sm, Eu, Gd, Dy, Ho, Er, Tm, Yb, and so forth) are superposed on top of one after another and coupled with one another by use of freely foldable coupling members (made of stainless steel and so forth) such as hinges (Step in FIG. 1(A)).

Subsequently, these members for bulk superconducting magnets are inserted into a solenoid coil in a state where they are superposed on top of one after another, then a magnetizing process is applied to these members for bulk superconducting magnets, thereafter they are cooled to the critical temperature or lower in the magnetic field while keeping in the same state (Step in FIG. 1(B)).

Then, a magnetic field by the solenoid coil is removed and the magnetized superposed body of the members for the magnetized bulk superconducting magnets is taken out from the solenoid coil.

Figure 1B:
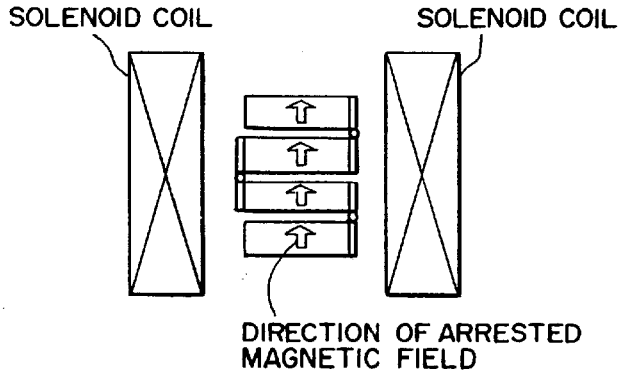
Figure 1C:
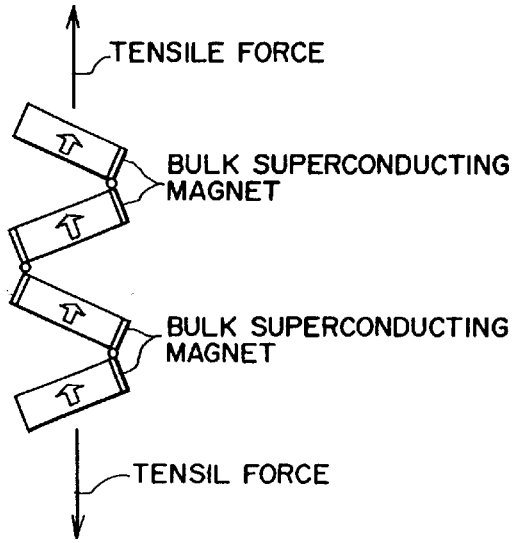
Figure 1D:
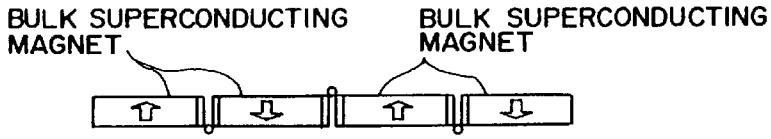

Thereafter, the magnetized superposed body of the members for the magnetized bulk superconducting magnets are unfolded alternately and stretched by a guide screw or lever that are prepared in advance (Step in FIG. 1(C)), and they are juxtaposed and fixed as shown in FIG. 1(D).

In the foregoing process, "a coupled body comprised of bulk superconducting magnets in which the bulk superconducting magnets are magnetized in different directions and alternately lined up" shown in Step in FIG. 1(D) can be simply and easily produced by a one time magnetizing process using a single coil having a small bore diameter.

Further, if the foregoing guide screw or lever is utilized so as to unfold the superposed body of the members for the magnetized bulk superconducting magnets, the bulk superconducting magnets which are strongly come into contact with each other can be detached from each other (unfolded) and juxtaposed easily so that the difficulty and risk to line up such bulk superconducting magnets can be thoroughly avoided.

If the magnetizing process is applied to a superposed body of the members for the bulk superconducting magnets by keeping superposing faces of the respective members for the bulk superconducting magnets in an half-open state so as to have an angle formed between the superposing faces of the adjacent members for the bulk superconducting magnets without the superposing faces coming into close contact with each other, when a magnetizing process is applied to the superposed body of the members for the bulk superconducting magnets, the superposed body of the members for the magnetized bulk superconducting magnets can be easily released. This is caused by the fact that since magnetic attraction of the magnets increases or decreases at "duplicate ratio of distance", if the superposed body of the members for the magnetized bulk superconducting magnets is in a half-open state, a force for releasing it is reduced considerably.

As means for keeping a superposed body of the members for the bulk superconducting magnets in a half-open state, a method of sandwiching known materials on open ends of each magnet that does not adversely affect a magnetizing process when the magnetizing process is applied to the members for the bulk superconducting magnets while they are superposed on top of one after another.

The larger an angle formed between the superposing faces of the adjacent members for the bulk superconducting magnets is when the foregoing magnetizing process is applied, the more easily the members for the bulk superconducting magnets are released after the magnetizing process while a magnetic field becomes small. Accordingly, it is preferable to study an angle formed between the superposing faces of the adjacent members for the bulk superconducting magnets where the superposed body of the same members is easily released an angle formed between the superposing faces of the adjacent members for the bulk superconducting magnets and has a large magnetic field in each case, and select the optimum angle satisfying them case by case.

Figure 2:
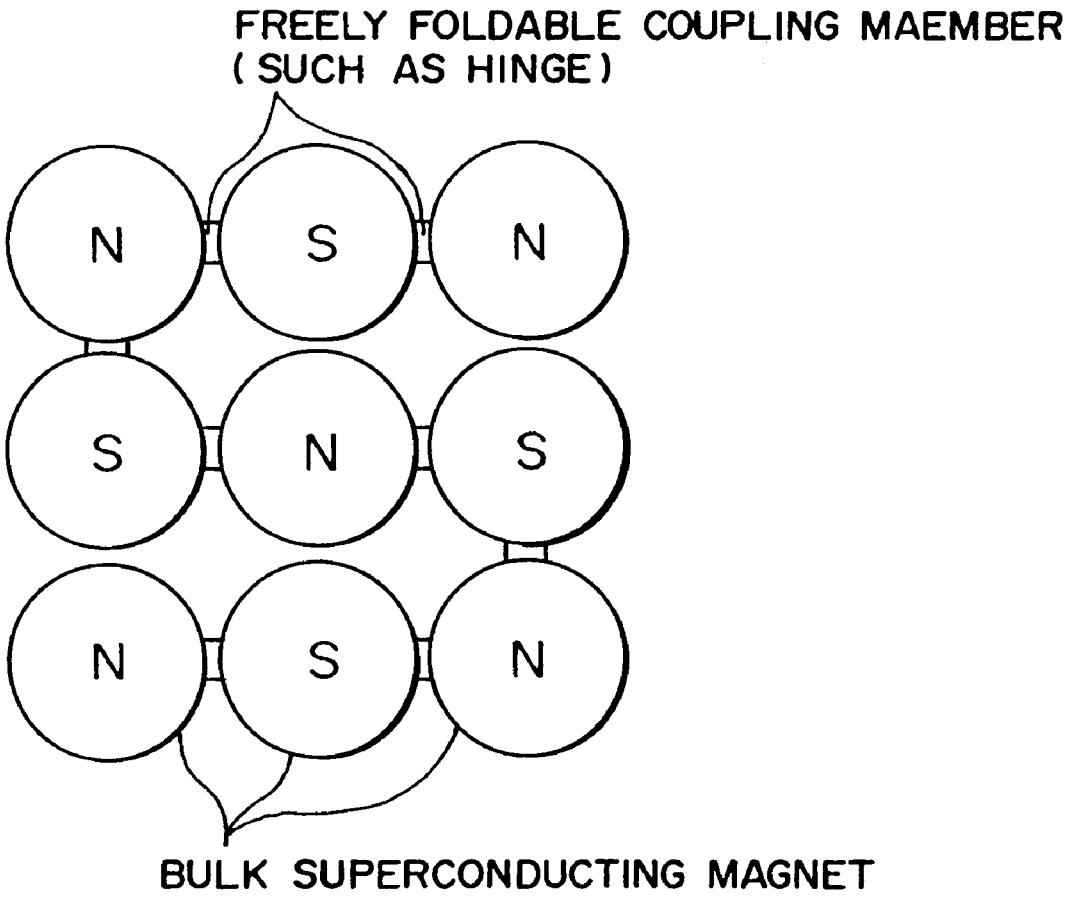
FIG. 2 is a typical view of a coupled body composed of multi-pole bulk superconducting magnets with respective polarities varying which are lined up in a two-dimensional direction.

Although FIG. 1(A) to FIG. 1(D) show a case of producing a coupled body comprised of multi-pole bulk superconducting magnets with respective polarities varying are juxtaposed linearly, if a method of superposing the members for bulk superconducting magnets before the magnetic process is devised, it is possible to produce a coupled body comprised of multi-pole bulk superconducting magnets with respective polarities varying which are lined up in a two-dimensional direction as shown in FIG. 2, thereby obtaining a material for use in a positioning member or a physical distribution system that requires a magnetic driving or propulsion force in a two-dimensional direction.

Further, it is possible to obtain a coupled body comprised of multi-pole bulk superconducting magnets capable of representing a magnetic propulsion force in a three-dimensional direction by selecting a method of superposing the members for bulk superconducting magnets wherein multi-pole bulk superconducting magnets with respective polarities varying are lined up in a three-dimensional direction when the superposed body of the members for the bulk superconducting magnets are unfolded, so that such a coupled body comprised of multi-pole bulk superconducting magnets is expected to contribute to a high performance of, e.g., a magnetic separator and so forth.

Concrete Example

Four Y—Ba—Cu—O based oxide superconducting bulk bodies each of which is square and has both a and b sides each having a length of 40 mm and a thickness of 10 mm are prepared, and hinges made of stainless steel are respectively fixed to these superconducting bulk bodies, thereby producing a coupled body as shown in FIG. 1(A).

Subsequently, a coupled body comprised of the bulk superconducting magnets is folded and superposed as shown in FIG. 1(B), and it is inserted into a solenoid coil, then, a magnetic process is applied thereto in a magnetic field of 1 T, and it is cooled to the temperature of a liquid nitrogen temperature (77.3 K) while keeping in the same state.

Subsequently, the magnetized superposed body of the members for the bulk superconducting magnets is taken out from the solenoid coil after the magnetic field by the solenoid coil is removed, then the members for the bulk superconducting magnets are alternately unfolded and stretched as shown in FIG. 1(C), thereafter they are juxtaposed and fixed as shown in FIG. 1(D).

Each magnetic field distribution of the thus obtained coupled body of the bulk superconducting magnets is inspected and found that 0.5 T in a surface magnetic field is alternately arranged.

As mentioned in detail above, according to the invention, the "coupled body comprised of multi-pole bulk superconducting magnets with respective polarities varying" having e.g. an alternating magnetic field can be obtained easily at low cost by a one time magnetizing process with a simple facility and without risk, resulting in a very efficient industrial effect.

What is claimed is:

1. A magnetizing method for producing a coupled body comprised of multi-pole bulk superconducting magnets with respective polarities varying, comprising the steps of:

coupling adjacent members for bulk superconducting magnets of a plurality of members for bulk superconducting magnets with each other in such a way as to be freely superposable, foldable, and unfoldable:

superposing all the members for the bulk superconducting magnets on top of one after another, and applying a magnetizing process thereto in as superposed state; and unfolding alternately and juxtaposing the respective bulk superconducting magnets as superposed after the magnetizing process.

2. A magnetizing method for producing a coupled body comprised of multi-pole bulk superconducting magnets with respective polarities varying, wherein the magnetizing process is applied to a superposed body of the members for the bulk superconducting magnets by keeping superposing faces of the respective members for the bulk superconducting magnets in an half-open state so as to have an angle formed between the superposing faces of the adjacent members for the bulk superconducting magnets without the superposing faces coming into close contact with each other.

* * * * *